United States Patent [19]

Krishna et al.

[11] Patent Number: 4,980,045

[45] Date of Patent: Dec. 25, 1990

[54] HEAVY OIL PRETREATMENT PROCESS WITH REDUCED SULFUR OXIDE EMISSIONS

[75] Inventors: Ashok S. Krishna, Concord, Calif.; David J. Bott, Downingtown, Pa.; Theresa A. Pecoraro, Danville, Calif.

[73] Assignee: Chevron Research Company, San Francisco, Calif.

[21] Appl. No.: 227,275

[22] Filed: Aug. 2, 1988

[51] Int. Cl.[5] ..... C10G 25/09

[52] U.S. Cl. ..... 208/91; 208/88; 208/127; 208/299; 208/300; 208/302; 208/303; 208/305; 423/244

[58] Field of Search ..... 208/91, 299, 300, 302, 208/303, 305, 88, 127; 423/244

[56] References Cited

U.S. PATENT DOCUMENTS

| | | | |
|---|---|---|---|
| 2,956,004 | 10/1960 | Conn et al. | 208/91 |
| 4,028,223 | 6/1977 | Hayes et al. | 208/91 |
| 4,071,436 | 4/1978 | Blaton, Jr. et al. | 208/113 |
| 4,152,250 | 5/1979 | Inooker et al. | 208/213 |
| 4,243,514 | 1/1981 | Bartholic | 208/91 |
| 4,263,128 | 4/1981 | Bartholic | 208/294 |
| 4,311,580 | 1/1982 | Bartholic | 208/91 |
| 4,325,817 | 4/1982 | Bartholic et al. | 208/164 |
| 4,328,091 | 5/1982 | Bartholic | 208/299 |
| 4,414,098 | 11/1983 | Zandona et al. | 208/91 |
| 4,427,538 | 1/1984 | Bartholic | 208/127 |
| 4,544,645 | 10/1985 | Kaassen et al. | 502/66 |
| 4,569,754 | 2/1986 | Moore | 208/91 |
| 4,585,544 | 4/1986 | Gartside et al. | 208/127 |
| 4,592,829 | 6/1986 | Eberly, Jr. | 208/91 |
| 4,659,452 | 4/1987 | Howell | 208/91 |
| 4,668,378 | 5/1987 | Miyauchi et al. | 208/127 |
| 4,795,545 | 1/1989 | Schmidt | 208/91 |
| 4,861,458 | 8/1989 | Martin et al. | 208/127 |
| 4,915,820 | 4/1990 | Hettinger, Jr. | 208/127 |

FOREIGN PATENT DOCUMENTS

| | | | |
|---|---|---|---|
| 0063683 | 11/1982 | European Pat. Off. | 208/305 |

*Primary Examiner*—Helane E. Myers

[57] ABSTRACT

A process is provided for the pretreatment of heavy oil feeds to demetalate and remove coke precursors. Inert, sorbent material is utilized in a reaction zone to effect the contaminant removal and is cycled to a regeneration zone. The sorbent also adsorbs sulfur oxides produced in a regeneration zone which are then cycled back to the reaction zone, converted to hydrogen sulfide, and removed from the system. The preferred sorbent material is high surface area alumina, having an average surface area in the circulating inventory of greater than 100 $m^2/g$.

11 Claims, No Drawings

HEAVY OIL PRETREATMENT PROCESS WITH REDUCED SULFUR OXIDE EMISSIONS

FIELD OF THE INVENTION

This invention relates generally to the pretreatment of heavy oils, in particular to the suppression or mitigation of the dehydrogenation effects of metals, such as nickel, vanadium, iron, and coke precursors, such as asphaltenes, using an inert, sorbent material which is substantially free of cracking activity and suitable for the adsorption of sulfur oxides produced in the process. The inert, sorbent material is included as a circulating inventory in said process, and is cycled between a reaction zone and a regeneration zone.

BACKGROUND OF THE INVENTION

Residual fractions and heavy oils obtained from the distillation of crude petroleum often contain substantial amounts of metals, such as nickel, vanadium, iron, copper and sodium, and have a high concentration of asphaltenes, polynuclear aromatics and other coke precursors. In a catalytic cracking process, particularly a fluidized process such as FCC, these metals and coke precursors significantly and adversely affect the cracking ability of the catalyst, and, over time, will poison and/or deactivate it. In order to render the heavy oil or residual fractions more suitable as feedstocks for FCC and hydrocracking processes, it is advantageous to pretreat the residual oils first, in the absence of hydrogen, to remove substantial portions of the metals and coke precursor contaminants. A typical pretreatment process involves contacting the high boiling oils with an inert, sorbent material exhibiting relatively low or no significant cracking activity, under conditions of time, temperature, and pressure sufficient to reduce the metals and Conradson carbon residue values of the residual oil feed to within more acceptable limits for downstream processing.

The art suggests many processes for the reduction of metals and coke precursors in residual and other contaminated oils, in the absence of added hydrogen. One such process is described in U.S. Pat. Nos. 4,243,514; 4,263,128; 4,311,580; 4,238,091; and 4,427,538, assigned to Engelhard, Minerals and Chemicals, Inc., which patents are incorporated herein by reference. The process described in the Engelhard patents is known in the art as the "Asphalt Residual Treating (ART) Process" and generally relates to the pretreating of residual oils to produce acceptable cracking stock for FCC-type units.

In that process, inert solids are introduced into a unit mechanistically similar to an FCC unit for the removal of metals and carbon contaminants. Those inert solids comprise a circulating inventory, which circulates from a reactor zone, where contaminants are deposited on the solid particles, to a regeneration zone where carbon-containing contaminants are removed from the inert material by thermal decomposition. The particles are then available for recycle back to the reaction zone. In the ART process, the claimed particles have a low surface area, i.e., less than about 100 $m^2/g$, preferably below 50 $m^2/g$, most preferably below 25 $m^2/g$ and in actual practice around 10 to 15 $m^2/g$. The particles are ordinarily composed of kaolin or clay which has been spray dried into microspheres. For a specific description of this process, see in particular U.S. Pat. Nos. 4,263,128 and 4,243,514.

Many feeds however, particularly heavy feeds, also contain high levels of sulfur as an additional contaminant. In this process, the sulfur is converted to sulfur oxides, which are environmentally harmful pollutants and notoriously difficult to handle easily. In the prior art, this $SO_x$ problem is generally dealt with by removing it from the system and separately treating it. See, for example, U.S. Pat. No. 4,325,817. However, this is believed to be generally cumbersome and inefficient.

Cracking processes, particularly fluid catalytic cracking, also have $SO_x$ problems, and it is known in the art to use separate particles for the reduction of $SO_x$ emissions from them. In preferred processes, high surface area alumina is cycled between the FCC reactor zone and a regenerator zone. The alumina adsorbs the $SO_x$, which is formed in the regeneration zone by the thermal decomposition of the sulfur-containing contaminants, from the catalyst particles. The $SO_x$-containing alumina is then recycled to the reactor zone Where the reducing atmosphere converts the $SO_2$ or $SO_3$ to $H_2S$, which is subsequently removed and treated by conventional means. It is also known and preferred to use promoters for the promotion of $SO_2$ to $SO_3$, to take advantage of the enhanced ability of alumina to adsorb $SO_3$. Suitable examples of prior art processes in this area include U.S. Pat. Nos. 4,071,436; 4,115,250; and 4,544,645. The preferred alumina in these prior art processes is a high surface area active alumina, suitable for the adsorption of $SO_x$.

SUMMARY OF THE INVENTION

According to the present invention, a process is provided for the pretreatment of hydrocarbon oil feed containing contaminant metals and coke precursors while also reducing the production of gaseous contaminants produced thereby. The process comprises contacting a hydrocarbon feed containing metals and sulfur contaminants with an inert, sorbent material in a fluidized reaction zone, said sorbent material having an average surface area of greater than about 100 $m^2/g$, and circulating said sorbent material between said reactor zone and said regeneration zone, so that the two zones operate as an integrated system, wherein said sorbent particles are specifically effective for sorbing sulfur oxide generated in said regeneration zone. The preferred sorbent material comprises alumina, more preferably, reactive or gamma alumina.

In an alternative embodiment, it is provided that inert, sorbent material, having a surface area less than 100 $m^2/g$, is introduced into the circulating inventory of a process having a regenerator and a reactor zone. The conditions, particular temperature, of the regenerator are such that the inert material is calcined very quickly into a material having a surface area of greater than 100 $m^2/g$, and also providing an average surface area for the circulating inventory of greater than 100 $m^2/g$. It is also contemplated that the preferred sorbent material can be a portion of the entire circulating inventory, and that the sorbent portion has an average surface area of greater than 100 $m^2/g$.

Among other factors, the present invention is based on our finding that the use of higher surface area sorbent particles, particularly alumina, not only provides effective metals and coke precursor removal in a hydrocarbon heavy oil feed pretreatment process, but also significantly reduce sulfur oxide contaminants produced in that process. We have also found that the preferred gamma alumina trihydrate particulate material substantially increases in surface area after addition to the process. Further, we have found that, even with the relatively high surface area particulate material, the coke make of the process in not prohibitively high.

DETAILED DESCRIPTION OF THE INVENTION

As discussed above, many residual oils or other heavy hydrocarbons contain unacceptably high levels of contaminants, particularly, metals, such as vanadium and nickel, coke precursors, such as Conradson carbon and asphaltenes, and sulfur. In order to use these feeds effectively, particularly in contaminant-sensitive processes such as fluid catalytic cracking, it is often beneficial to pretreat them to remove significant portions of these contaminants, which would ordinarily foul or poison the cracking catalyst.

One preferred method of pretreatment, which is known in the art, is to use a process, which is mechanistically similar to an FCC process, comprising a reaction zone containing a fluidized bed of particles and a regeneration zone, joined together in a recycle system. The fluidized particles in the reaction zone act as metal traps and absorbers of the coke precursors, all of which renders the feed much more amenable to downstream processing. The particles, however, become contaminated themselves over time and need to be regenerated. The preferred method of regeneration is to recycle the particles out of the reactor zone into a regeneration zone, where the carbon- and sulfur-containing deposits are thermally decomposed at elevated temperatures in the range of 1000° to 1300° F. and removed from the particles, thereby reactivating the sorbent particles for recycle back to the reactor.

One commercial process utilizing similar technology, is the so-called Asphalt Residual Treating (Art) Process developed by the Engelhard Minerals and Chemicals Corporation. The Engelhard ART process uses low surface area, spray dried kaolin or clay microspheres as the particle of choice in their pretreatment process. As taught in U.S Pat. No. 4,243,514, Bartholic, the surface area of the particles is below about 100 $m^2/g$ (BET using nitrogen absorption), preferably below about 50 $m^2/g$, and most preferably below about 25 $m^2/g$. The microspheres are fine particles, preferably of kaolin clay, which have been spray dried and calcined at a temperature from about 1600° to 2100° F. In practice, the typical microspheres have an even lower surface area, i.e. below about 15 $m^2/g$. This contrasts distinctly with the present process in which the effective particles have a surface area greater than 100 $m^2/g$.

The present process is particularly desirable for feeds having a high degree of metallic contaminants and Conradson carbon coke precursors. Typical feeds include crude petroleum, atmospheric residuum which may contain components boiling as low as 500° F., and vacuum residuum typically boiling above about 900° F. The process may also be used for other metals-containing feedstocks, such as those containing nickel and vanadium porphyrins which are known catalyst poisons. Such feeds may include the product of coal liquefaction, shale oil, tar sand effluent, or any other hydrocarbon feed which may need to be treated prior to introduction to an FCC unit as a catalytic charge stock.

The process of the present invention is preferably carried out in a system which includes both a pretreatment or reaction zone and a separate solids regeneration zone. The regeneration zone is integral with the reaction zone, and the inert, sorbent material used to effect the demetalation or decarbonization is cycled between the two zones in a circulating inventory of material. In a preferred embodiment, the process is arranged sequentially with a conventional fluid catalytic cracking process unit downstream U.S. Pat. No, 4,243,514, incorporated herein by reference, describes a suitable process for the pretreatment of the heavy oils generally. The apparatus is similar to an FCC unit in general, in that it includes the two zones discussed above. The solids may be initially introduced either separate from or integral with the feed. Due to contamination and degradation of the particles over time, solids material needs to be continuously or periodically removed from the system and replaced with an equal quantity of fresh makeup solids to maintain suitable overall contaminant metals levels on the solids. While solids replacement is a continuing operation, the metals levels on the solids will continue to increase until the coke and gas make become excessively high, at which point the operation can be stopped and the entire inventory replaced.

The feed charge may be preheated prior to introduction into the system to an appropriate temperature, preferably between about 200° F. and 800° F., more preferably, 300° F. to 700° F. The reactor is operated at a preferred temperature of between 800° F. to 1000° F. The pressure in the reactor zone is preferably maintained between about 10 and 35 psig, and in the regenerator between about 5 to 30 psig.

The Sorbent Material

The inert, sorbent material finding use in the present invention generally comprises solid contact particles which are essentially inert to cracking. By "inert" is meant the particles induce minimal cracking of heavy hydrocarbons in the process. The standard microactivity test is used to measure cracking capability. Using that test, the particles of the present invention have a standard microactivity of about 30 or less, and more preferably, less than about 20. Although the particles are essentially inert, due to the temperature of the reaction zone, minimal thermal cracking may be induced. This is irrespective, however, of the nature of the particles themselves.

Many feeds containing high levels of metals and coke precursors also contain undesirably high levels of sulfur. It has been found that using high surface area inert, sorbent material not only facilitates the removal of the metals and coke precursors, but allows for the adsorption of sulfur oxides which are generated. In the process, the sulfur-containing contaminants are adsorbed onto the particles along with the other contaminants. In essence, therefore, the particles are performing a dual function: demetalation/decarbonization and sulfur oxide removal.

The contaminant-containing contact particles are then cycled to the regeneration zone, where the carbon and sulfur contaminants are essentially removed from the particles by thermal decomposition. In this environment, the sulfur contaminants are oxidized to sulfur oxides which create a significant potential pollution problem. The high surface area particles, preferably alumina, more preferably containing active alumina, however, readsorb the sulfur oxides on their surface in the regenerating zone. The particles are then recycled back to the reaction zone.

In the reducing atmosphere of the reaction zone, the sulfur oxides are converted to hydrogen sulfide and expelled from the particles. The hydrogen sulfide produced may then be much more easily removed from the reaction zone and handled through any conventional treatment process. This superior ability to adsorb sulfur oxides is distinctive to the high surface area particles, and would not be available using the low surface area materials of the prior art.

As discussed above, the particles themselves may be any material having a cracking capability of less than 20. They are preferably fine microspheres, preferably porous, having an average surface area of greater than 100 $m^2/g$, and an affinity for effectively adsorbing sulfur oxides. While many metal oxides may be appropriate, including the oxides of magnesium, aluminum and calcium, the preferred material is aluminum oxide or alumina. The most preferred form is reactive alumina, preferably gamma alumina, which has a particular affinity for sulfur oxide adsorption.

By "average surface area" is meant the average surface area of those particles of sorbent material in the circulating inventory having effectiveness for $SO_x$ adsorption. While individual particles, due to contamination on the surface or degradation over time, may be above or below the 100 $m^2/g$ limit, the makeup rate of the sorbent material introduced into the system is maintained such that the average surface area of a randomly selected individual particle having $SO_x$ sorption ability would be above the 100 $m^2/g$ threshold.

The reactive alumina, which is a preferred alumina species, may comprise all or part of the alumina particle, or may be used as an alumina phase in a heterogeneous particle further comprising a mixture with one or more other refractory materials, e.g., inorganic oxides. We have found that substantially pure alumina contains about 1 to 2 weight percent reactive alumina.

The reactive alumina is preferably employed as a component of the particulate solid. The amount of reactive alumina included in the particulate solid is at least sufficient to react with the desired amount of sulfur compounds in the gas being treated to form one or more solid compounds containing aluminum atoms and sulfur atoms. If the contact time between the particulate solids and the gas being treated is shorter than is necessary to allow complete reaction of all the available reactive alumina in the particulate solid, then a proportional, additional amount of the particulate solid may be employed to remove the desired amount of sulfur compounds from the gas.

In some cases, it may be possible to substitute other suitable materials for the reactive alumina to form one or more sulfur-containing compounds. Particularly useful may be reactive magnesium oxide or magnesia. When it is desired to use reactive magnesium in removing sulfur compounds from the gas, its concentration in the solid particle may be determined, and the particles used may be employed, in exactly the same manner as the alumina described above. Mixtures of high surface area magnesia with high surface area alumina may also be used.

We have found that high surface area alumina has properties which are essential for use in preferred embodiments of the present invention. Specifically, alumina reacts with sulfur oxide to form fairly stable sulfates at temperatures in the range of from 1000° F. to 1500° F. in a nonreducing atmosphere. Secondly, the sulfates of alumina (or magnesium) can be reduced to their sulfides in a reducing atmosphere at temperatures in the range of from 800° F. to 1300° F., and third, the sulfides of aluminum will react by hydrolysis to form hydrogen sulfide gas at temperatures in the range from 800° F. to 1300° F., i.e., in the reaction zone.

While it is contemplated that the entire circulating inventory of the system may comprise the preferred high surface area alumina, it is also within the contemplation of the invention that the alumina may be included as an additive in the process. As an additive, the alumina sorbent material may comprise between about 1 and 50 percent by weight, preferably between about 2 and 20 weight percent, of the entire circulating inventory. Again, the average surface area of the inert alumina portion effective for $SO_x$ adsorption of the circulating inventory is maintained above 100 $m^2/g$. It is also within the contemplation of the invention that the remaining portion of the circulating inventory of the sorbent material may be less than 100 $m^2/g$. This additional sorbent material may be comprised of any suitable material which is advantageous for the demetalation and decarbonization of the feed, but which does not show a specific affinity for adsorption of sulfur oxides. See, for example, the materials listed in U.S. Pat. No. 4,243,514, incorporated herein by reference.

Also, it is contemplated that the particular inert, sorbent material finding use in this invention may, over time, degrade such it has a surface area below 100 $m^2/g$. However, this material in no way adversely effects the invention herein, and can be considered to be a part of the inventory of this invention.

In an alternative embodiment, inert, sorbent material may also be introduced which has an average surface area of less than 100 $m^2/g$, and which may be as low as 50 $m^2/g$ prior to introduction into the system. However, the temperature and reaction conditions of the system are such that the particles are almost immediately calcined into particles having an individual surface area of greater than 100 $m^2/g$, and generally greater than 150 $m^2/g$. This is generally referred to as "in situ" calcination.

Sulfur Oxide Removal

The sulfur-containing gases which are removed by the present invention are produced during regeneration of the sorbent material. Sulfur oxides are present in these gases in the form of both sulfur dioxide and sulfur trioxide. In order for the gaseous sulfur compounds in such gases to be reacted with the alumina, the flue gases should also contain an amount of molecular oxygen to react stoichiometrically to form a sulfate with the sulfur component of the gaseous sulfur compound and the gas stream. The amount of oxygen required, if any, depends upon the type and amount of gaseous sulfur compounds, such as sulfur dioxide or trioxide, which is desired to be removed from the gas being treated.

The alumina and the gas to be treated are contacted in the regeneration zone at a temperature of about 1000° F. to 1500° F. Sulfur trioxide or sulfur dioxide and the high surface area alumina are reacted within this temperature range to form one or more solid compounds containing sulfur atoms and aluminum atoms. The sulfur component of the sulfur oxide is believed to be converted to the sulfate form, so that the solid compounds formed include sulfates of aluminum, such as aluminum oxysulfates and aluminum sulfate. The composition of the one or more specific solid sulfur and aluminum-containing compounds formed is not important, however. We have found that the solid sulfur-containing compounds thus formed are stable at 1000° F. to 1500° F. in the flue gas. This property, rather than the composition of the compounds formed, is essential to the removal of the sulfur from the system.

By reacting gaseous compounds of sulfur in the system to form the one or more solid compounds, the sulfur is effectively moved from the process. In general, up to 95% of the sulfur oxides may be removed. The solid sulfur-containing compounds are then subjected to the reducing environment of the reaction zone to form alumina and release hydrogen sulfide. This is preferably accomplished by contacting the particulate solid with a hydrocarbon at a temperature of 800° F. to 1300° F., preferably, 850° F. to 1100° F., and reacting the solid sulfur-containing compound with one or more components of the hydrocarbon. Ordinarily, the compounds would contact the hydrocarbon in the reaction zone of the present invention. The resulting hydrogen sulfide, and any other fluid sulfur compounds which may incidentally be formed, then may be separated from the resulting sulfur-depleted particulate solid. Preferentially, the hydrogen sulfide formed by the reaction is continuously separated from the particulate solid as a component of the hydrocarbon stream, or as a flue gas which is separated from the system and handled using any conventional hydrogen sulfide handling means.

Alternatively, some hydrogen sulfide and sulfur oxides may remain on the particles, which, over time, may physically degrade to a particle size which is fine enough that it passes with flue gas from the system, providing an additional means of sulfur removal.

It has been demonstrated that sulfur trioxide is preferentially adsorbed over sulfur dioxide on the inert, sorbent particles. Therefore, it is also within the contemplation of the present invention that promoter metals or metals compounds may be included in the circulated inventory of the process to promote the formation of sulfur trioxide from sulfur dioxide.

These promoters are preferably separate components from the inert, sorbent material. Promoter metals finding particular use include platinum, palladium, iridium, rhodium, osmium, ruthenium, copper and chromium. These metals must be included in the system in such a manner, however, as not to constitute metallic contaminants of their own, and may be included on supports, preferably inorganic supports.

While the prior art recognizes the difficulty of sulfur removal from the system, the removal is not addressed in an manner or by a means which is integral with the system. See, for example, U.S. Pat. No. 4,325,817, Bartholic, also assigned to the Engelhard Company, in which the sulfur oxides are removed from the system and processed from it.

The following examples are present to illustrate objects and advantages of the present invention. However, it is not intended that the invention should be limited to the specific embodiments presented therein.

EXAMPLES

In this example, a series of experiments was carried out to demonstrate the change in surface area of the inert solid material contemplated for use in the process of the present invention upon calcination. The alumina material prior to heat treatment of any kind has virtually no surface area by conventional, nitrogen adsorption techniques because of its hydrous state. Upon calcination at 800° F. for 5 minutes, the surface area is 346 $m^2/g$, as shown in Table 1. Calcination of another batch of fresh material with a surface area of about 256$m^2/g$. Since the regenerator in the process of the present invention will operate at at least 1100° F., and since the residence time in the regenerator vessel of the inert solids is at least 5 minutes, this example shows that the fresh material that is added to the process will be calcined "in situ", and that its surface area will increase to levels greater than 200 $m^2/g$.

TABLE 1

| Calcination Conditions | | |
|---|---|---|
| Time, mins. | Temp., °F. | Surface Area, $m^2/g$ |
| 5 | 800 | 346 |
| 10 | 800 | 344 |
| 5 | 1200 | 256 |
| 10 | 1200 | 230 |
| 20 | 1200 | 242 |
| 40 | 1200 | 214 |

EXAMPLE II

In this Example, the alumina sorbent material of the present invention was steamed to simulate equilibrium that would be present in the inventory of the pretreatment unit. After steaming the material at 1350° F. for 2 hours in the presence of 10% steam, the surface area of the alumina was measured to be approximately 120 $m^2/g$.

EXAMPLE III

In this example, pretreatment test were carried out in a cyclic, fluidized bed pretreatment-regeneration unit. Hydrocarbon oil feed was fed over the fluidized bed of inert solids for period of time at prescribed pressure conditions. The oil flow was then stopped, the inert bed of sorbent material was steam-stripped, and the unit switched to a mode by introducing oxygen-containing gas to burn carbon from the sorbent in the fluidized bed reactor. During regeneration, the amount of CO, $CO_2$, and $SO_2$ in the flue gas was monitored. Following the unit was switched back to the pretreatment mode by re-introducing the hydrocarbon feed. This process was repeated for approximately 50 cycles for each test.

Comparative tests were conducted to compare two different sorbent materials. One of the materials used as the solid sorbent was a low surface area kaolin clay, typical of the material taught in the ART process as in U.S. Pat. Nos. 4,243,514; 4,263,128; 4,311,580; 4,238,091; and 4,427,538, assigned to Engelhard, Minerals and Chemicals, Inc. The other material was a high surface area alumina having properties consistent with the teachings of the present invention.

The results, shown in Table 2, clearly demonstrate that the test employing the high surface area alumina resulted in significantly lower $SO_x$ emissions in the flue gas, despite higher yields of carbon, than the low surface area kaolin material.

TABLE 2

| Material | S.A., $m^2/g$ | Carbon on solids, wt % | Sulfur as $SO_x$ in Coke | $SO_x$ in Flue gas, ppm |
|---|---|---|---|---|
| Kaolin | 20 | 0.22 | 1.05 | 450 |
| Alumina | 144 | 0.43 | 0.33 | 150 |

What is claimed is:

1. A process for the pretreatment before fluidized catalytic cracking or hydrocracking of a heavy hydrocarbonaceous feedstock containing metals and sulfur contaminants, in an apparatus comprising two zones; said process comprising:

(1) in a fluidized bed reaction zone contacting said feedstock with an inert sorbent material, said sorbent material having an average surface area greater than about 100 $m^2/g$; and (2) circulating said sorbent material between said reaction zone and a regeneration zone, such that the two zones operate as an integrated system wherein said sorbent particles are effective for sorbing sulfur oxides generated in said regeneration zone and releasing hydrogen sulfide in said reaction zone.

2. The process as claimed in claim 1 wherein said sorbent material comprises alumina.

3. The process as claimed in claim 2 wherein said sorbent material comprises gamma-alumina.

4. The process as claimed in claim 1 wherein said inert sorbent material has a MAT activity of about 30 or less.

5. The process as claimed in claim 4 wherein said material has a MAT activity of less than about 20.

6. The process as claimed in claim 1 wherein said sorbent material circulating between said reaction zone and said regeneration zone has an average surface area upon introduction into said process of less than 50 $m^2/g$, and wherein said process is operated under conditions sufficient to heat said sorbent material to a temperature sufficient to cause the average surface area of said sorbent material to become greater than 100 $m^2/g$.

7. The process as claimed in claim 6 wherein the average surface area of said sorbent material is monitored and a fresh sorbent material having an average surface area upon calcination of about 150 $m^2/g$ is introduced into said process to maintain sufficient sorbent material having a surface area greater than 100 $m^2/g$ for the purpose of effectively reducing sulfur oxide emissions.

8. The process according to claim 7 wherein said calcination occurs within about between 0 and about 5 minutes of introduction of said sorbent material into said process.

9. The process as claimed in claim 7 wherein said regeneration zone is operated at a temperature between about 1100° F. and 1400° F. to effect said calcination.

10. The process as claimed in claim 6 wherein said fresh sorbent material is added at a makeup rate between about 0.1% to 10% by weight of total material per day.

11. The process as claimed in claim 1 wherein said inert sorbent material having a surface area greater than 100 $m^2/g$ comprises from about 0.1 to 10 weight percent of the total sorbent material in said process.

* * * * *